US009202652B2

(12) United States Patent
Naka et al.

(10) Patent No.: US 9,202,652 B2
(45) Date of Patent: Dec. 1, 2015

(54) ELECTROMAGNETIC CONTACTOR

(75) Inventors: Yasuhiro Naka, Kounosu (JP); Kouetsu Takaya, Kounosu (JP); Kenji Suzuki, Kounosu (JP); Hiroyuki Tachikawa, Yokohama (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/115,263

(22) PCT Filed: Apr. 3, 2012

(86) PCT No.: PCT/JP2012/002327
§ 371 (c)(1), (2), (4) Date: Nov. 12, 2013

(87) PCT Pub. No.: WO2012/157170
PCT Pub. Date: Nov. 22, 2012

(65) Prior Publication Data

US 2014/0062625 A1 Mar. 6, 2014

(30) Foreign Application Priority Data

May 19, 2011 (JP) ..... 2011-112906

(51) Int. Cl.
*H01H 67/02* (2006.01)
*H01H 50/42* (2006.01)
(Continued)

(52) U.S. Cl.
CPC ..... *H01H 50/42* (2013.01); *H01H 33/64* (2013.01); *H01H 50/546* (2013.01); *H01H 51/06* (2013.01); *H01H 51/22* (2013.01); *H01H 2050/025* (2013.01)

(58) Field of Classification Search
CPC ..... H01H 51/065
USPC ..... 335/126, 131
See application file for complete search history.

(56) References Cited

U.S. PATENT DOCUMENTS 2,121,657 A * 6/1938 Fisher ..... 335/245
3,444,490 A * 5/1969 Bowles et al. ..... 335/126
(Continued)

FOREIGN PATENT DOCUMENTS

CN 101341564 A 1/2009
JP H01-268005 A 10/1989
(Continued)

OTHER PUBLICATIONS

Europe Patent Office, "Search Report for EP 12785142.6," May 12, 2015.
(Continued)

*Primary Examiner* — Alexander Talpalatski
(74) *Attorney, Agent, or Firm* — Manabu Kanesaka

(57) ABSTRACT

An electromagnetic contactor has a pair of fixed contacts disposed maintaining a predetermined interval and a movable contact disposed to be capable of connecting to and separating from the pair of fixed contacts; and an electromagnet unit that drives the movable contact. The electromagnet unit includes a magnetic yoke enclosing a plunger drive portion; a movable plunger in which a leading end is protruding through an aperture formed in the magnetic yoke, and urged by a return spring; and an annular permanent magnet enclosing a peripheral flange portion formed on a protruding end side of the movable plunger, and magnetized in a moving direction of the movable plunger.

14 Claims, 14 Drawing Sheets

(51) Int. Cl.

| | |
|---|---|
| ***H01H 51/22*** | (2006.01) |
| ***H01H 33/64*** | (2006.01) |
| ***H01H 51/06*** | (2006.01) |
| ***H01H 50/54*** | (2006.01) |
| *H01H 50/02* | (2006.01) |

(56) References Cited

U.S. PATENT DOCUMENTS

| | | | | |
|---|---|---|---|---|
| 4,345,224 | A | 8/1982 | Lenzing | |
| 4,940,958 | A | 7/1990 | Ootsuka | |
| 5,546,061 | A * | 8/1996 | Okabayashi et al. | 335/78 |
| 5,917,394 | A * | 6/1999 | Fuchs | 335/229 |
| 5,959,519 | A | 9/1999 | Gobel et al. | |
| 7,852,178 | B2 * | 12/2010 | Bush et al. | 335/126 |
| 7,911,301 | B2 * | 3/2011 | Yano et al. | 335/131 |
| 8,222,980 | B2 * | 7/2012 | Yamagata et al. | 335/126 |
| 8,228,144 | B2 * | 7/2012 | Sugisawa et al. | 335/78 |
| 8,674,796 | B2 * | 3/2014 | Ito et al. | 335/260 |
| 8,937,518 | B2 * | 1/2015 | Suzuki et al. | 335/126 |
| 2009/0096559 | A1 | 4/2009 | Yano et al. | |
| 2010/0008009 | A1 | 1/2010 | Cartier-Millon et al. | |
| 2010/0165535 | A1 | 7/2010 | Pohl | |
| 2011/0241809 | A1 * | 10/2011 | Sugisawa et al. | 335/188 |
| 2012/0293284 | A1 * | 11/2012 | Niimi et al. | 335/185 |

FOREIGN PATENT DOCUMENTS

| | | | |
|---|---|---|---|
| JP | H10-125196 | A | 5/1998 |
| JP | 2007-059460 | A | 3/2007 |
| JP | 2010-062079 | A | 3/2010 |

OTHER PUBLICATIONS

China Patent Office, "Office Action for CN 201280023776.4," Apr. 3, 2015.

* cited by examiner

ELECTROMAGNETIC CONTACTOR

RELATED APPLICATIONS

The present application is National Phase of International Application No. PCT/JP2012/002327 filed Apr. 3, 2012, and claims priority from Japanese Applications No. 2011-112906 filed May 19, 2011.

TECHNICAL FIELD

The present invention relates to an electromagnetic contactor including fixed contacts, a movable contact connectable to and detachable from the fixed contacts, and an electromagnet unit that drives the movable contact.

BACKGROUND ART

For this kind of electromagnetic contactor, a polarized electromagnet device, which is a polarized electromagnet device that drives a movable iron core portion against the return force of a spring using the combined suctioning force of the suctioning force of permanent magnets and the suctioning force of an electromagnetic coil, wherein one magnetic pole surface of the permanent magnets contacts each of two central pieces of a C-shaped fixed iron core, and the other magnetic pole surface contacts a central piece of a pair of L-shaped magnetic pole plates disposed on the outer side of the electromagnetic coil inside the fixed iron core, has been proposed as a drive device that drives the movable contact disposed so as to be capable of connecting to and separating from the fixed contacts (for example, refer to Patent Literatures 1 and 2).

CITATION LIST

Patent Literature

Patent Literature 1: JP-A-2-91901
Patent Literature 2: U.S. Pat. No. 5,959,519

SUMMARY OF INVENTION

Technical Problem

However, the heretofore known example described in Patent Literatures 1 and 2 is such that the pair of L-shaped magnetic pole plates is disposed on the outer side of the electromagnetic coil, and the permanent magnets are disposed symmetrically between a plate portion of each of the magnetic pole plates facing the electromagnetic coil and the fixed iron core. Consequently, two permanent magnets, a left and a right, are needed, and the distance between the permanent magnets and a portion on which the suctioning force of the movable iron core acts is long, because of which there is an unsolved problem in that it is not possible to efficiently use the magnetic force of the permanent magnet.

Therefore, the invention, having been contrived focusing on the heretofore described unsolved problem of the heretofore known example, has an object of providing an electromagnetic contactor such that the necessary magnetic force is obtained by one permanent magnet, rather than using a plurality of permanent magnets, and it is possible to efficiently use the magnetic force of the permanent magnet.

Solution to Problem

In order to achieve the heretofore described object, an electromagnetic contactor according to one aspect of the invention includes a pair of fixed contacts disposed maintaining a predetermined interval and a movable contact disposed so as to be capable of contacting to and separating from the pair of fixed contacts, and an electromagnet unit that drives the movable contact. The electromagnet unit includes a magnetic yoke enclosing a plunger drive portion, a movable plunger in which a leading end is protruding through an aperture formed in the magnetic yoke and urged by a return spring, and an annular permanent magnet fixed enclosing a peripheral flange portion formed on a protruding end side of the movable plunger, magnetized in a moving direction of the movable plunger.

According to this configuration, because the permanent magnet is provided so as to enclose the peripheral flange portion of the movable plunger, it is possible to cause the magnetic force of the annular permanent magnet to act without exception on the peripheral flange portion of the movable plunger, and thus possible to efficiently use the magnetic force of the annular permanent magnet. Also, by causing suctioning force enabling the movable contact to move in a releasing direction to act on the movable plunger, it is possible to reduce the urging force of the return spring. Because of this, it is possible to reduce the magnetomotive force of an exciting coil, thus reducing the size of the electromagnet unit. Also, it is possible to suction the peripheral flange portion of the movable plunger in a released condition using the magnetic force of the permanent magnet, and thus possible to secure a high anti-malfunction performance when releasing.

Also, it is preferable that the electromagnetic contactor is such that the magnetic yoke is configured of a U-shaped cross-sectional magnetic yoke having an upper portion opened, and supporting a spool wound with an exciting coil and having the movable plunger movably disposed in a central portion of the spool, and an upper magnetic yoke spanning the opened upper portion of the magnetic yoke, and the upper magnetic yoke is formed with an aperture through which the movable plunger is inserted, and the annular permanent magnet is disposed on a periphery of the aperture.

According to this configuration, it is possible to suction the movable plunger with the magnetic force of the annular permanent magnet in a released condition, and to form a magnetic circuit with the U-shaped magnetic yoke and upper magnetic yoke, and the movable plunger, when engaging.

Also, it is preferable that the electromagnetic contactor is such that the annular permanent magnet is disposed on the periphery of the aperture on an outer surface of the upper magnetic yoke, and includes on an auxiliary yoke on a side opposite to the upper magnetic yoke and facing a side opposite of the upper magnetic yoke of the peripheral flange portion of the movable plunger.

According to this configuration, the magnetic force of the annular permanent magnet acts directly on the peripheral flange portion of the movable plunger via the auxiliary yoke, because of which it is possible to suppress the leakage current, and more efficiently use the magnetic force of the annular permanent magnet.

Also, it is preferable that the electromagnetic contactor is such that the thickness of the permanent magnet is set to the sum of the thickness of the peripheral flange portion of the movable plunger and the stroke of the movable plunger.

According to this configuration, it is possible to determine the stroke of the movable plunger using the thickness of the permanent magnet, and thus possible to reduce to a minimum the cumulative number of parts and form tolerance, which affect the stroke of the movable plunger. Also, it is possible to determine the stroke of the movable plunger using only the thickness of the annular permanent magnet and the thickness of the peripheral flange portion of the movable plunger, and thus possible to minimize variation of the stroke.

Also, it is good when the electromagnetic contactor is such that at least the fixed contacts and movable contact, and the movable plunger, are disposed in a receptacle in which gas is encapsulated.

According to this configuration, conduction and interruption of a large current is possible.

Advantageous Effects of Invention

According to the invention, it is possible to suction the peripheral flange portion of the movable plunger with the one annular permanent magnet, and thus possible to reduce the number of parts, achieving a reduction in cost.

Also, as the annular permanent magnet is disposed so as to enclose the peripheral flange portion of the movable plunger, the annular permanent magnet can be disposed in the vicinity of the position in which the suctioning force is caused to act, and it is thus possible to efficiently use the magnetic force of the annular permanent magnet.

Furthermore, it is possible to cause the suctioning force of the annular permanent magnet to act so as to suction the movable plunger in the released condition, and possible to suppress by this amount the urging force of the return spring, which causes the movable plunger to return to the released condition. Because of this, the magnetomotive force of the exciting coil is reduced, and it is possible to reduce the height of the electromagnet unit, and thus possible to reduce the overall size of the electromagnetic contactor. At the same Lime, the movable plunger is suctioned by the permanent magnet when releasing, and it is possible to reliably prevent the movable contact from coming into unintended contact with the pair of fixed contacts due to vibration, shock, or the like.

DESCRIPTION OF EMBODIMENTS

Hereafter, a description will be given, based on the drawings, of an embodiment of the invention.

Figure 1:
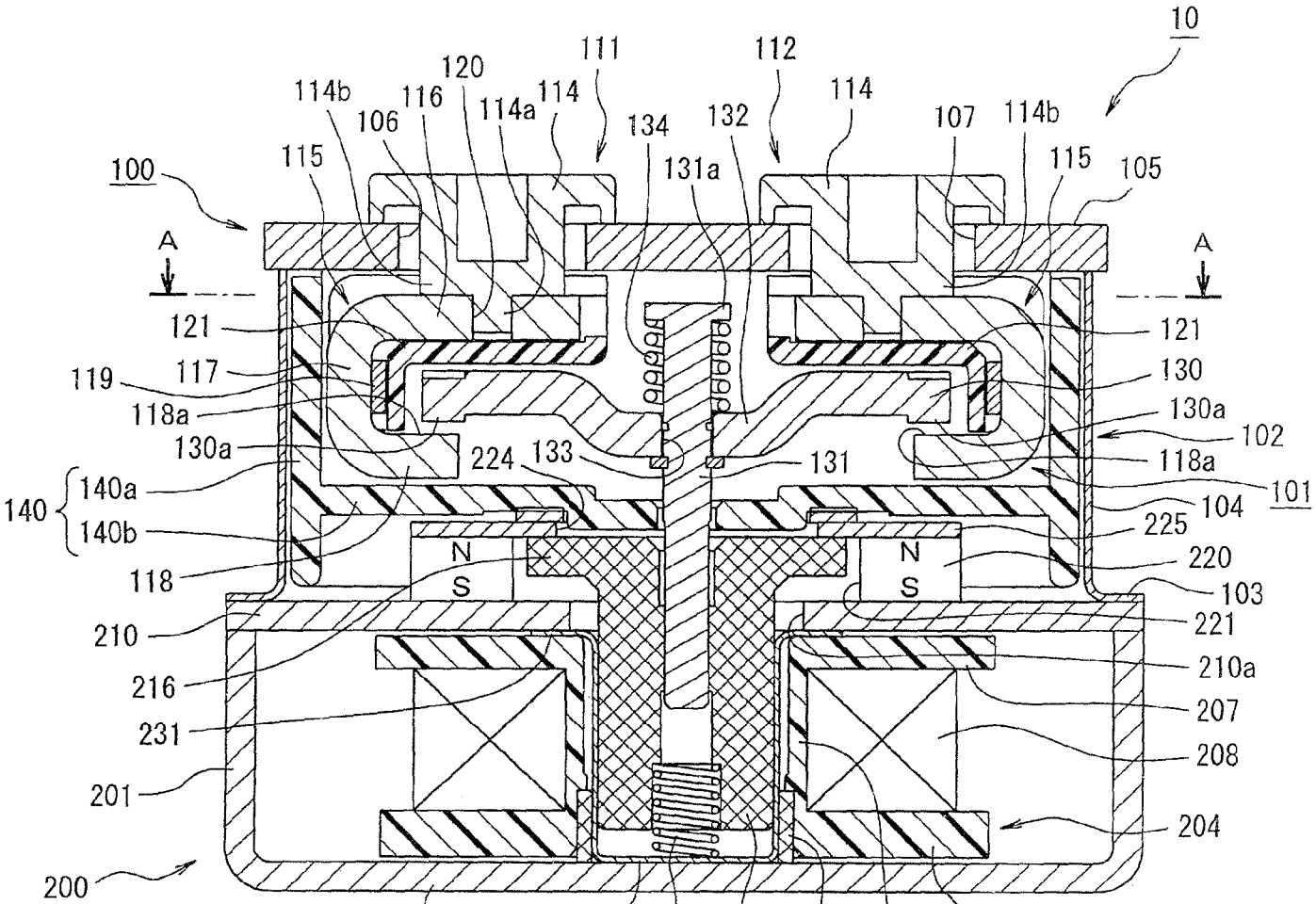
FIG. 1 is a sectional view showing an embodiment of an electromagnetic contactor according to the invention.
Figure 2B:
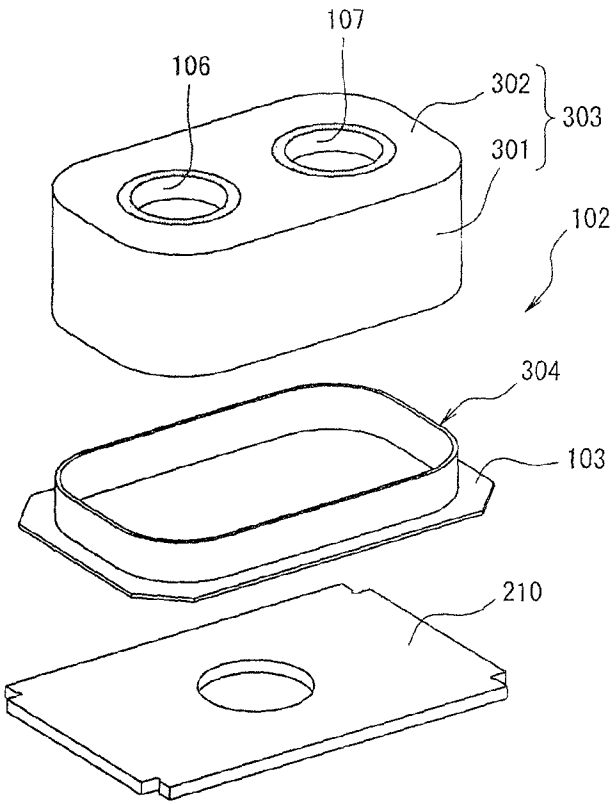
FIGS. 2(*a*), 2(*b*) are exploded perspective views of a contact housing case.
Figure 2A:
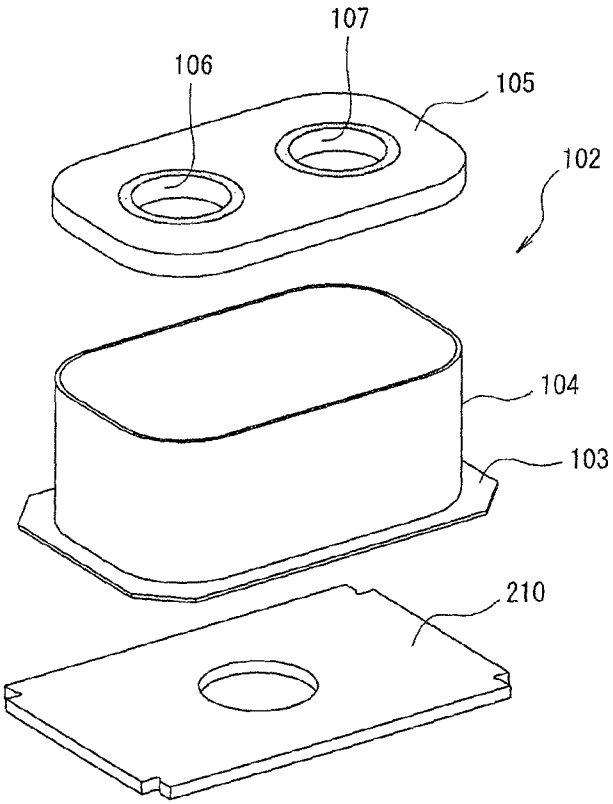

FIG. 1 is a sectional view showing one example of an electromagnetic contactor according to the invention, while FIGS. 2(*a*), 2(*b*) are exploded perspective views of a contact housing case. In FIG. 1 and FIGS. 2(*a*), 2(*b*), reference 10 is an electromagnetic contactor, and the electromagnetic contactor 10 is configured of a contact device 100 in which is disposed a contact mechanism, and an electromagnet unit 200 that drives the contact device 100.

The contact device 100 has a contact housing case (an arc extinguishing chamber) 102 that houses a contact mechanism 101, as is clear from FIG. 1 and FIGS. 2(*a*), 2(*b*). The contact housing case 102 includes a metal tubular body 104 having on a lower end portion a metal flange portion 103 protruding outward, and a fixed contact support insulating substrate 105 configured of a plate-like ceramic insulating substrate that closes off the upper end of the metal tubular body 104, as shown in FIG. 2(*a*).

The metal tubular body 104 is such that the flange portion 103 thereof is seal joined and fixed to an upper portion magnetic yoke 210 of the electromagnet unit 200, to be described hereafter.

Also, through holes 106, 107 in which is inserted a pair of fixed contacts 111, 112, to be described hereafter, are formed maintaining a predetermined interval in a central portion of the fixed contact support insulating substrate 105. A metalizing process is performed around the through holes 106, 107 on the upper surface side of the fixed contact support insulating substrate 105, and in a position on the lower surface side that contacts the tubular body 104. In order to carry out the metalizing process, copper foil is formed around the through holes 106, 107, and in the position that contacts the tubular body 104, in a condition wherein a plurality of the fixed contact support insulating substrate 105 are arranged vertically and horizontally on a flat surface.

The contact mechanism 101, as shown in FIG. 1, includes the pair of fixed contacts 111, 112 inserted into and fixed in the through holes 106, 107 of the fixed contact support insulating substrate 105 of the contact housing case 102. Each of the fixed contacts 111, 112 includes a support conductor portion 114, having on an upper end a flange portion protruding outward, inserted into the through holes 106, 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* formed protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Further, an insulating cover 121, made of a synthetic resin material that regulates arc generation is mounted on the C-shaped portion 115 of each of the fixed contacts 111, 112. The insulating cover 121 covers the inner peripheral surfaces of the upper plate portion 116 and intermediate plate portion 117 of the C-shaped portion 115, as shown in FIGS. 3(*a*), 3(*b*).

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and a fitting portion 125, formed on the inward side from the upper end of the side plate portions 123, 124, that fits onto a small diameter portion 114*b* formed on the support conductor portion 114 of the fixed contacts 111, 112.

Figure 3A:
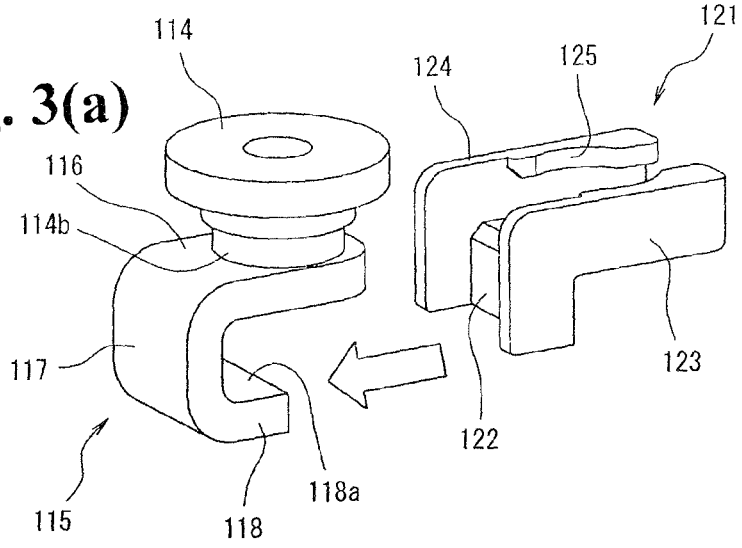
FIGS. 3(*a*)-3(*c*) are diagrams showing an insulating cover of a contact device, wherein FIG. 3(*a*) is a perspective view, FIG. 3(*b*) is a plan view before mounting, and FIG. 3(*c*) is a plan view after mounting.
Figure 3B:
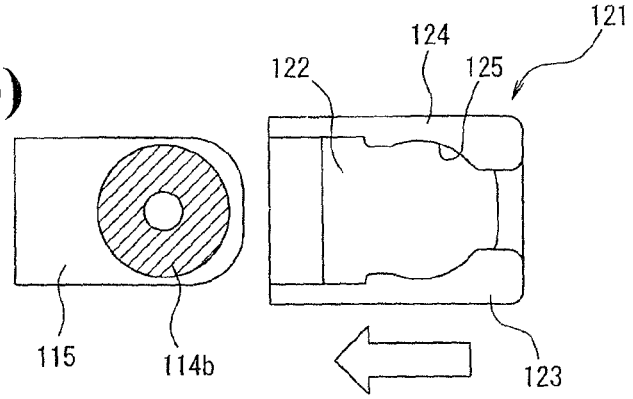
Figure 3C:
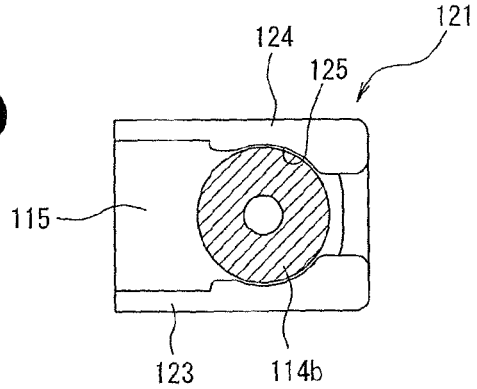

Consequently, the insulating cover 121 is placed in a condition in which the fitting portion 125 is facing the small diameter portion 114*b* of the support conductor portion 114 of the fixed contacts 111, 112, as shown in FIGS. 3(*a*), 3(*b*), after which, the fitting portion 125 is fitted onto the small diameter portion 114*b* of the support conductor portion 114 by pushing the insulating cover 121 onto the small diameter portion 114*b*, as shown in FIG. 3(*a*).

Figure 4A:
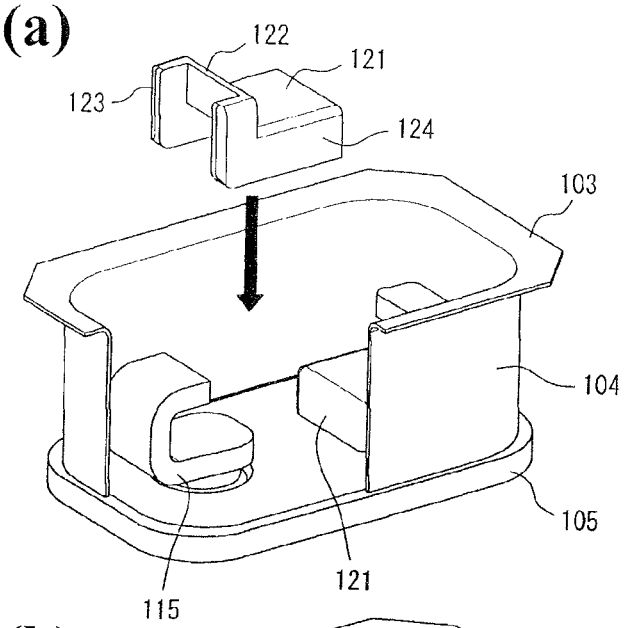
FIGS. 4(*a*)-4(*c*) are illustrations showing an insulating cover mounting method.
Figure 4B:
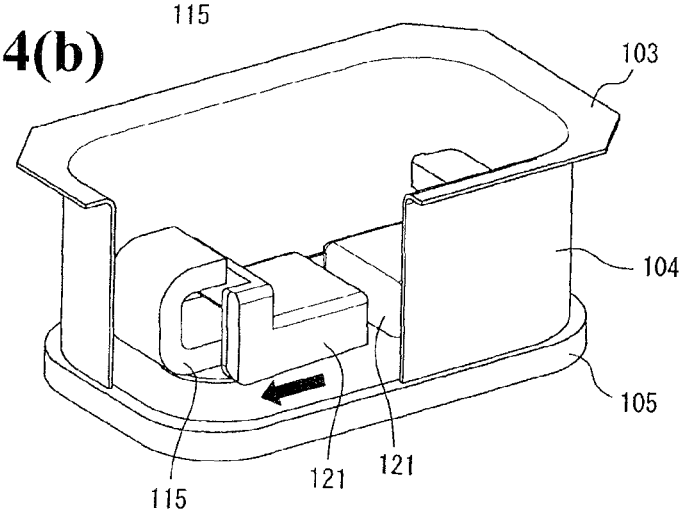
Figure 4C:
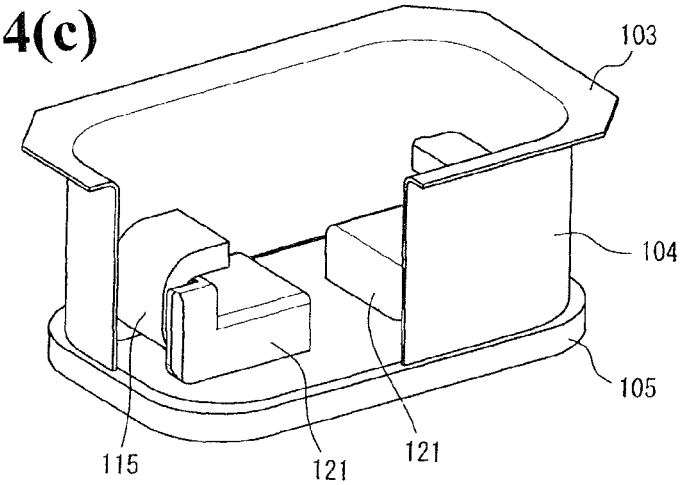

Actually, with the contact housing case 102 after the fixed contacts 111, 112 have been attached in a condition wherein the fixed contact support insulating substrate 105 is on the lower side, the insulating cover 121 is inserted from an upper aperture portion between the fixed contacts 111 and 112 in a condition vertically the reverse of that in FIGS. 3(*a*) to 3(*c*), as shown in FIG. 4(*a*).

Next, in a condition in which the fitting portion 125 is contacting the fixed contact support insulating substrate 105, as shown in FIG. 4(*b*), the fitting portion 125 is engaged with and fixed to the small diameter portion 114*b* of the support conductor portion 114 of the fixed contacts 111 and 112 by pushing the insulating cover 121 to the outer side, as shown in FIG. 4(*c*).

By mounting the insulating cover 121 on the C-shaped portion 115 of the fixed contacts 111 and 112 in this way, only the upper surface side of the lower plate portion 118 of the inner peripheral surface of the C-shaped portion 115 is exposed, and forms a contact portion 118*a*.

Figure 5:
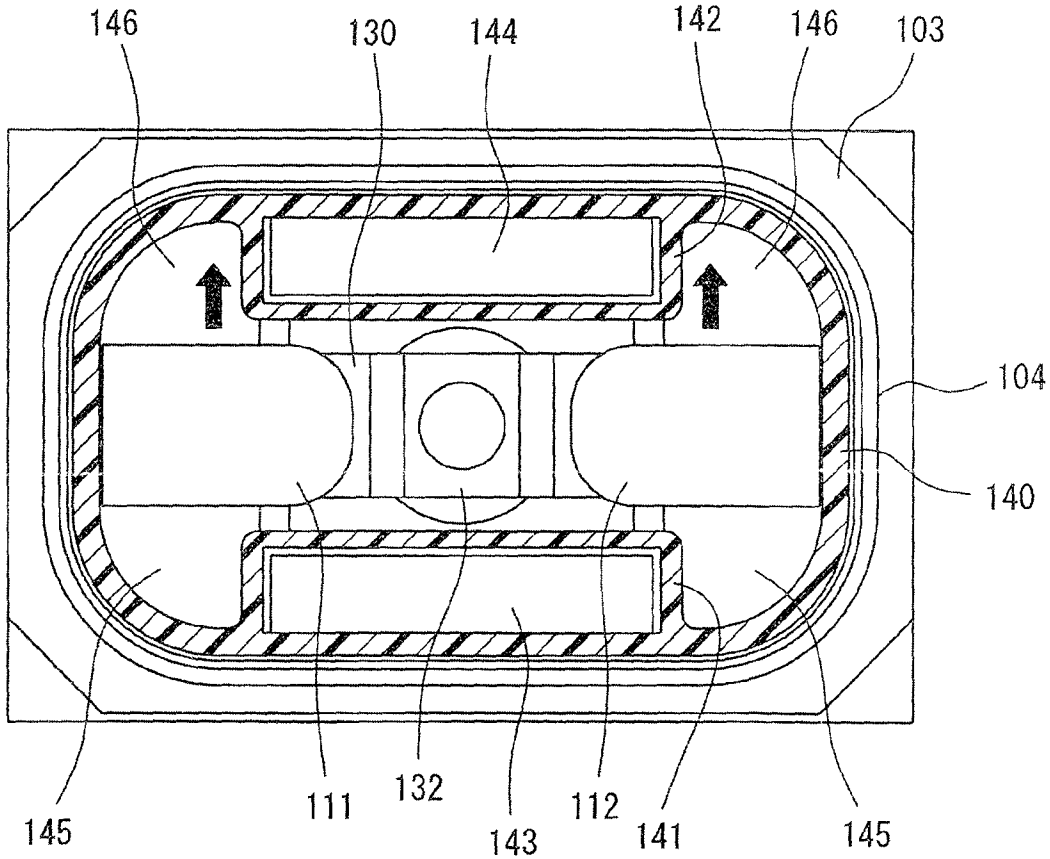
FIG. 5 is a sectional view along a line A-A in FIG. 1.

Further, the movable contact 130 is disposed in such a way that the two end portions thereof are disposed on each in the C-shaped portions 115 of the fixed contacts 111, 112. The movable contact 130 is supported by a connecting shaft 131 fixed to a movable plunger 215 of the electromagnet unit 200, to be described hereafter. The movable contact 130 is such that, as shown in FIG. 1 and FIG. 5, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*, and the movable contact 130 is positioned using, for example, a C-ring 135 so as to obtain a predetermined urging force from the contact spring 134.

The movable contact 130, in a released condition, takes on a condition wherein the contact portions 130*a* at either end and the contact portions 118*a* of the lower plate portions 118 of the C-shaped portions 115 of the fixed contacts 111, 112 are separated from each other and maintaining a predetermined interval. Also, the movable contact 130 is set so that, in an engaged position, the contact portions at either end contact the contact portions 118*a* of the lower plate portions 118 of the C-shaped portions 115 of the fixed contacts 111, 112 at a predetermined contact pressure owing to the contact spring 134.

Furthermore, an insulating cylinder 140 made of, for example, a synthetic resin is disposed on the inner peripheral surface of the metal tubular body 104 of the contact housing case 102, and magnet housing pockets 141, 142 are formed in positions on the insulating cylinder 140 facing the side surfaces of the movable contact 130. Arc extinguishing permanent magnets 143, 144 are inserted into and fixed in the magnet housing pockets 141, 142.

The arc extinguishing permanent magnets 143, 144 are magnetized in a thickness direction so that mutually opposing faces thereof are homopolar, for example, N-poles. Also, the arc extinguishing permanent magnets 143, 144 are set so that both end portions in a left-right direction are slightly inward of positions in which the contact portions 118*a* of the fixed contacts 111, 112 and the contact portions of the movable contact 130 are opposed, as shown in FIG. 5. Further, arc extinguishing spaces 145, 146 are formed on the outer sides in a left-right direction of the magnet housing pockets 141, 142 respectively.

By disposing the arc extinguishing permanent magnets 143, 144 on the inner peripheral surface side of the insulating cylinder 140 in this way, it is possible to bring the arc extinguishing permanent magnets 143, 144 near to the movable contact 130. Because of this, as shown in FIG. 6(*a*), magnetic flux $\phi$ emanating from the N-pole sides of the two arc extinguishing permanent magnets 143, 144 crosses portions in which the contact portions 118*a* of the fixed contacts 111, 112 and the contact portions 130*a* of the movable contact 130 are opposed in a left-right direction, from the inner side to the outer side, with a large flux density.

Figure 6A:
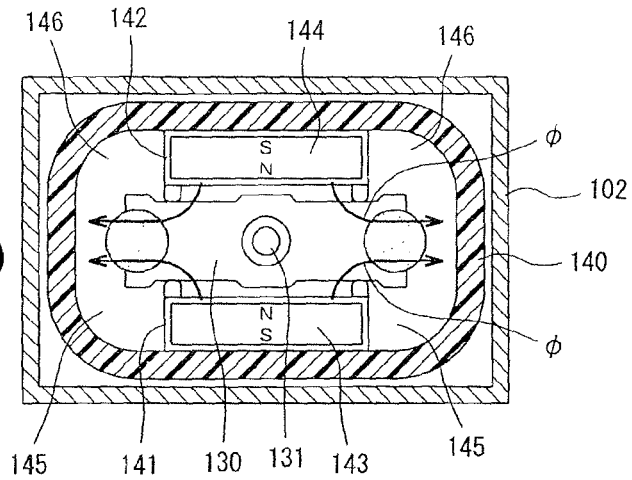
FIGS. 6(*a*)-6(*c*) are illustrations accompanying a description of arc extinguishing by an arc extinguishing permanent magnet according to the invention.
Figure 6B:
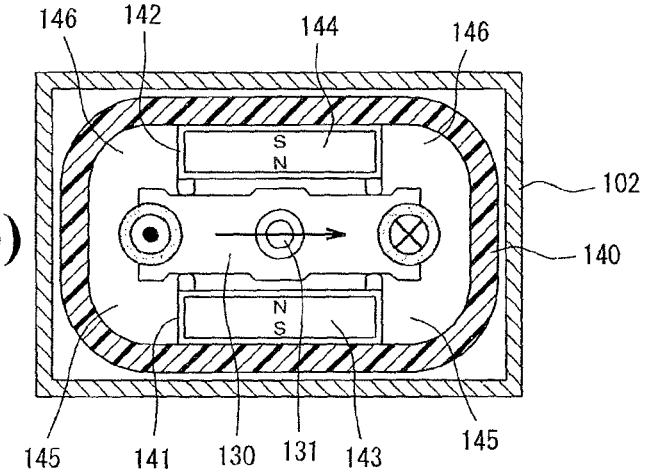
Figure 6C:
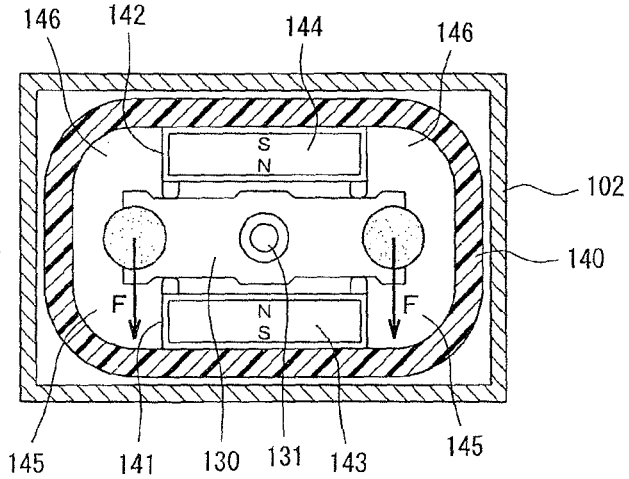

Consequently, assuming that the fixed contact 111 is connected to a current supply source and the fixed contact 112 is connected to a load side, the current direction in the engaged condition is such that the current flows from the fixed contact 111 through the movable contact 130 to the fixed contact 112, as shown in FIG. 6(*b*). Then, when changing from the engaged condition to the released condition by causing the movable contact 130 to move away upward from the fixed contacts 111, 112, an arc is generated between the contact portions 118*a* of the fixed contacts 111, 112 and the contact portions 130*a* of the movable contact 130.

The arc is extended to the arc extinguishing space 145 side on the arc extinguishing permanent magnet 143 side by the magnetic flux ϕ from the arc extinguishing permanent magnets 143, 144. At this time, as the arc extinguishing spaces 145, 146 are formed as widely as the thickness of the arc extinguishing permanent magnets 143, 144, it is possible to obtain a long arc length, and thus possible to reliably extinguish the arc.

Figure 7A:
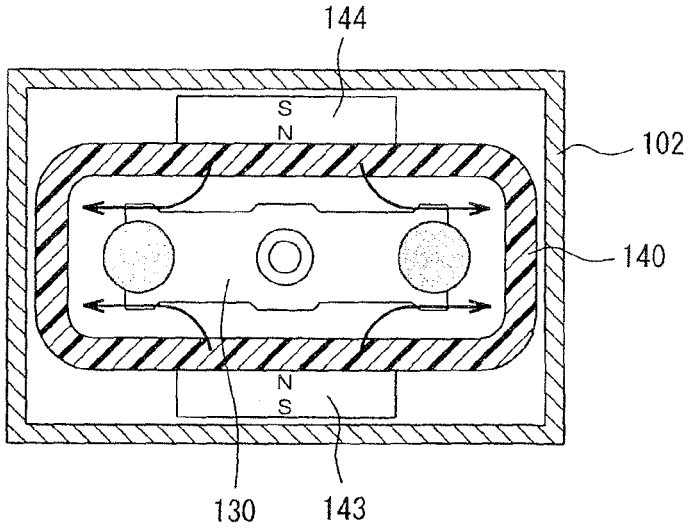
FIGS. 7(*a*)-7(*c*) are illustrations accompanying a description of arc extinguishing when the arc extinguishing permanent magnet is disposed on the outer side of an insulating case.
Figure 7B:
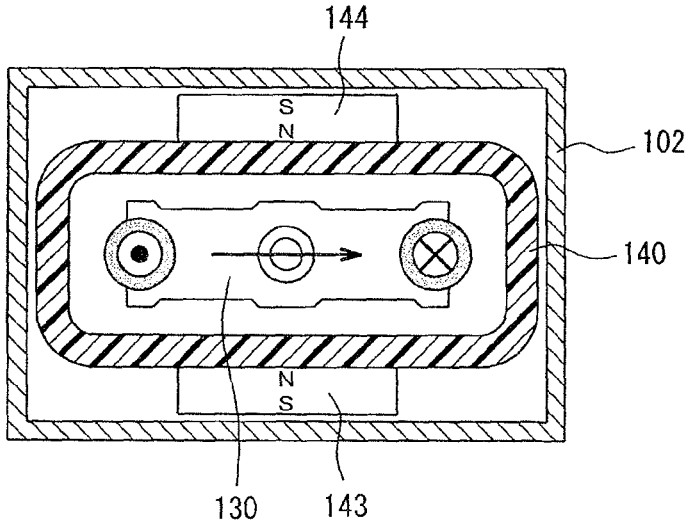
Figure 7C:
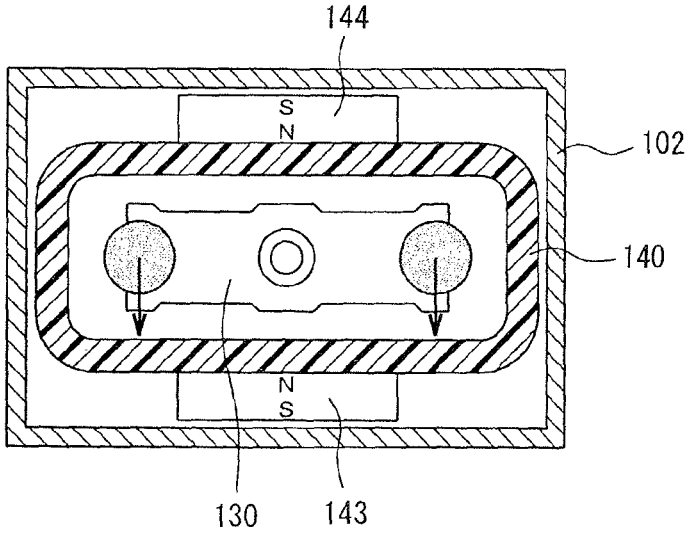

Incidentally, when the arc extinguishing permanent magnets 143, 144 are disposed on the outer side of the insulating cylinder 140, as shown in FIGS. 7(*a*) to 7(*c*), there is an increase in the distance to the positions in which the contact portions 118*a* of the fixed contacts 111, 112 and the contact portions 130*a* of the movable contact 130 are opposed, and when the same permanent magnets as in this embodiment are applied, the density of the magnetic flux crossing the arc decreases.

Because of this, the Lorentz force acting on an arc generated when shifting from the engaged condition to the released condition decreases, and it is no longer possible to sufficiently extend the arc. In order to improve the arc extinguishing performance, it is necessary to increase the magnetization of the arc extinguishing permanent magnets 143, 144.

Moreover, in order to shorten the distance between the arc extinguishing permanent magnets 143, 144 and the contact portions of the fixed contacts 111, 112 and movable contact 130, it is necessary to reduce the depth in a front-back direction of the insulating cylinder 140, and there is a problem in that it is not possible to secure sufficient arc extinguishing space to extinguish the arc.

However, according to the heretofore described embodiment, the arc extinguishing permanent magnets 143, 144 are disposed on the inner side of the insulating cylinder 140, meaning that the heretofore described problems occurring when the arc extinguishing permanent magnets 143, 144 are disposed on the outer side of the insulating cylinder 140 can all be solved.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed as a plunger drive portion on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* opposing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, a permanent magnet 220 formed in an annular shape is fixed to the upper surface of the upper magnetic yoke 210 so as to enclose the peripheral flange portion 216 of the movable plunger 215. The permanent magnet 220 has a through hole 221 enclosing the peripheral flange portion 216. The permanent magnet 220 is magnetized in an up-down direction, that is, a thickness direction, so that the upper end side is, for example, an N-pole while the lower end side is an S-pole. Taking the form of the through hole 221 of the permanent magnet 220 to be a form tailored to the form of the peripheral flange portion 216, the form of the outer peripheral surface can be any form, such as circular or rectangular.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 is opposed by the lower surface of the auxiliary yoke 225.

Figure 8:
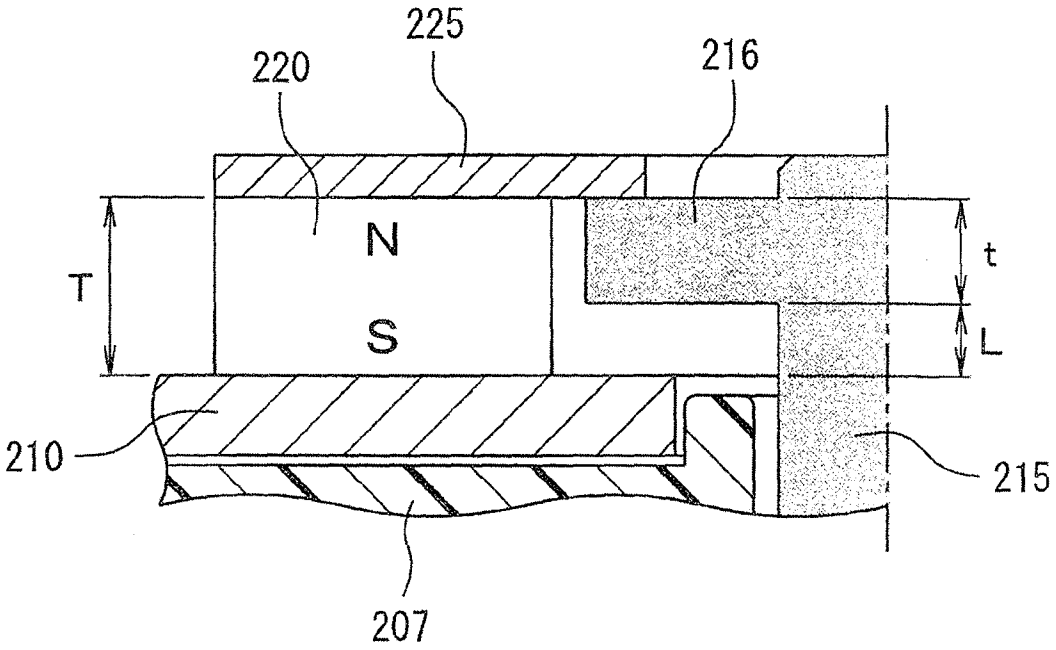
FIG. 8 is an enlarged sectional view showing the positional relationship between the permanent magnet and a movable plunger.

Herein, a thickness T of the permanent magnet 220 is set to a value (T=L+t) wherein a stroke L of the movable plunger 215 and a thickness t of the peripheral flange portion 216 of the movable plunger 215 are added together, as shown in FIG. 8. Consequently, the stroke L of the movable plunger 215 is regulated by the thickness T of the permanent magnet 220.

Because of this, it is possible to reduce to a minimum the cumulative number of parts and form tolerance, which affect the stroke of the movable plunger 215. Also, it is possible to determine the stroke L of the movable plunger 215 using only the thickness T of the permanent magnet 220 and the thickness t of the peripheral flange portion 216, and thus possible to minimize variation of the stroke L. In particular, this is more advantageous in the case of a small electromagnetic contactor in which the stroke is small.

Also, as the permanent magnet 220 is formed in an annular shape, the number of parts decreases in comparison with a case in which two permanent magnets are disposed symmetrically, as described in PTL 1 and 2, and a reduction in cost is achieved. Also, as the peripheral flange portion 216 of the movable plunger 215 is disposed in the vicinity of the inner peripheral surface of the through hole 221 formed in the permanent magnet 220, there is no waste in a closed circuit passing magnetic flux generated by the permanent magnet 220, leakage flux decreases, and it is possible to use the magnetic force of the permanent magnet effectively.

Also, the connecting shaft 131 that supports the movable contact 130 is screwed to the upper end surface of the movable plunger 215.

Further, in the released condition, the movable plunger 215 is urged upward by the return spring 214, and the upper surface of the peripheral flange portion 216 attains a released position wherein it contacts the lower surface of the auxiliary yoke 225. In this condition, the contact portions 130*a* of the movable contact 130 have moved away upward from the contact portions 118*a* of the fixed contacts 111, 112, causing a condition wherein current is interrupted.

In the released condition, the peripheral flange portion 216 of the movable plunger 215 is suctioned to the auxiliary yoke 225 by the magnetic force of the permanent magnet 220, and by a combination of this and the urging force of the return spring 214, the condition in which the movable plunger 215 contacts the auxiliary yoke 225 is maintained, with no unplanned downward movement due to external vibration, shock, or the like.

Figure 9A:
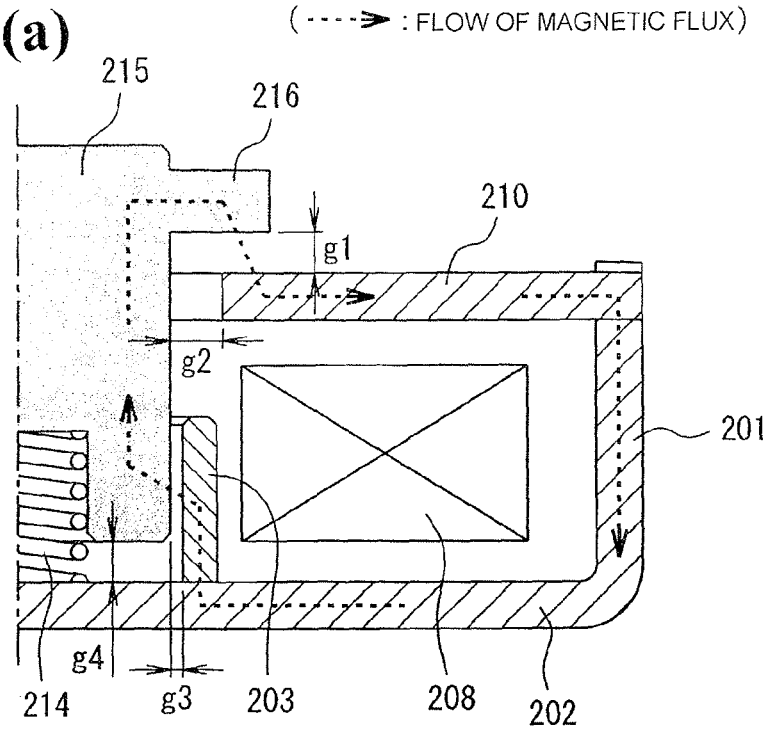
FIGS. 9(*a*), 9(*b*) are diagrams illustrating a movable plunger suctioning action by the permanent magnet, wherein FIG. 9(*a*) is a partial sectional view showing a released condition and FIG. 9(*b*) is a partial sectional view showing an engaged condition.
Figure 9B:
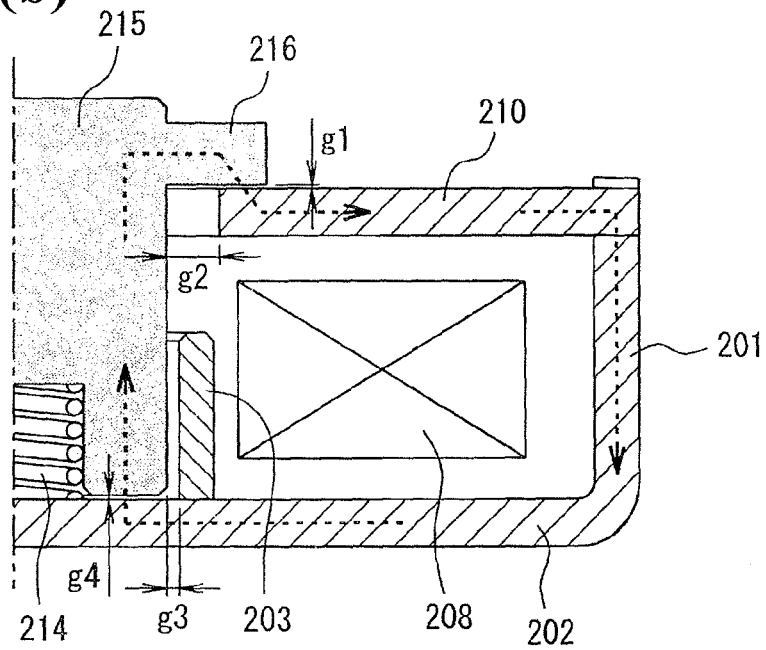

Also, in the released condition, as shown in FIG. 9(*a*), relationships between a gap g1 between the lower surface of the peripheral flange portion 216 of the movable plunger 215 and the upper surface of the upper magnetic yoke 210, a gap g2 between the outer peripheral surface of the movable plunger 215 and the through hole 210*a* of the upper magnetic yoke 210, a gap g3 between the outer peripheral surface of the movable plunger 215 and the cylindrical auxiliary yoke 203, and a gap g4 between the lower surface of the movable plunger 215 and the upper surface of the bottom plate portion 202 of the magnetic yoke 201 are set as below.

$g1<g2$ and $g3<g4$

Because of this, when exciting the exciting coil 208 in the released condition, the magnetic flux passes from the movable plunger 215 through the peripheral flange portion 216, passes through the gap g1 between the peripheral flange portion 216 and upper magnetic yoke 210, and reaches the upper magnetic yoke 210, as shown in FIG. 9(*a*). A closed magnetic circuit is formed from the upper magnetic yoke 210, through the U-shaped magnetic yoke 201 and through the cylindrical auxiliary yoke 203, as far as the movable plunger 215.

Because of this, it is possible to increase the magnetic flux density of the gap g1 between the lower surface of the peripheral flange portion 216 of the movable plunger 215 and the upper surface of the upper magnetic yoke 210, a larger suctioning force is generated, and the movable plunger 215 is caused to descend against the urging force of the return spring 214 and the suctioning force of the permanent magnet 220.

Consequently, the contact portions 130*a* of the movable contact 130 connected to the movable plunger 215 via the connecting shaft 131 contact the contact portions 118*a* of the fixed contacts 111, 112, and a current path is formed from the fixed contact 111, through the movable contact 130, toward the fixed contact 112, creating the engaged condition.

As the lower end surface of the movable plunger 215 nears the bottom plate portion 202 of the U-shaped magnetic yoke 201 on the engaged condition being created, as shown in FIG. 9(*b*), the heretofore described gaps g1 to g4 are as below.

$g1<g2$ and $g3>g4$

Because of this, the magnetic flux generated by the exciting coil 208 passes from the movable plunger 215 through the peripheral flange portion 216, and enters the upper magnetic yoke 210 directly, as shown in FIG. 9(*b*), while a closed magnetic circuit is formed from the upper magnetic yoke 210, through the U-shaped magnetic yoke 201, returning from the bottom plate portion 202 of the U-shaped magnetic yoke 201 directly to the movable plunger 215.

Because of this, a large suctioning force acts in the gap g1 and gap g4, and the movable plunger 215 is held in the down position. Because of this, the condition wherein the contact portions 130*a* of the movable contact 130 connected to the movable plunger 215 via the connecting shaft 131 are contacting the contact portions 118*a* of the fixed contacts 111, 112 is continued.

Further, the movable plunger 215 is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this condition, the exciting coil 208 in the electromagnet unit 200 is in a non-excited state, and there exists a released condition wherein no exciting force causing the movable plunger 215 to descend is being generated in the electromagnet unit 200. In this released condition, the movable plunger 215 is urged in an upward direction away from the upper magnetic yoke 210 by the return spring 214.

Simultaneously with this, a suctioning force created by the magnetic force of the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the auxiliary yoke 225.

Because of this, the contact portions 130*a* of the movable contact 130 of the contact mechanism 101 connected to the movable plunger 215 via the connecting shaft 131 are separated by a predetermined distance upward from the contact portions 118*a* of the fixed contacts 111, 112. Because of this, the current path between the fixed contacts 111, 112 is in an interrupted condition, and the contact mechanism 101 is in a condition wherein the contacts are opened.

In this way, as the urging force of the return spring 214 and the suctioning force of the annular permanent magnet 220 both act on the movable plunger 215 in the released condition, there is no unplanned downward movement of the movable plunger 215 due to external vibration, shock, or the like, and it is thus possible to reliably prevent malfunction.

On the exciting coil 208 of the electromagnet unit 200 being excited in the released condition, an exciting force is generated in the electromagnet unit 200, and the movable plunger 215 is pressed downward against the urging force of the return spring 214 and the suctioning force of the annular permanent magnet 220.

At this time, as shown in FIG. 9(*a*), the gap g4 between the bottom surface of the movable plunger 215 and the bottom plate portion 202 of the magnetic yoke 201 is large, and hardly any magnetic flux passes through the gap g4. However, the cylindrical auxiliary yoke 203 opposes the lower outer peripheral surface of the movable plunger 215, and the gap g3 between the movable plunger 215 and the cylindrical auxiliary yoke 203 is set to be small in comparison with the gap g4.

Because of this, a magnetic path passing through the cylindrical auxiliary yoke 203 is formed between the movable plunger 215 and the bottom plate portion 202 of the magnetic yoke 201. Furthermore, the gap g1 between the lower surface of the peripheral flange portion 216 of the movable plunger 215 and the upper magnetic yoke 210 is set to be small in comparison with the gap g2 between the outer peripheral surface of the movable plunger 215 and the inner peripheral surface of the through hole 210*a* of the upper magnetic yoke 210. Because of this, the magnetic flux density between the lower surface of the peripheral flange portion 216 of the movable plunger 215 and the upper surface of the upper magnetic yoke 210 increases, and a large suctioning force acts, suctioning the peripheral flange portion 216 of the movable plunger 215.

Consequently, the movable plunger 215 descends swiftly against the urging force of the return spring 214 and the suctioning force of the annular permanent magnet 220. Because of this, the descent of the movable plunger 215 is stopped by the lower surface of the peripheral flange portion 216 contacting the upper surface of the upper magnetic yoke 210, as shown in FIG. 9(*b*).

By the movable plunger 215 descending in this way, the movable contact 130 connected to the movable plunger 215 via the connecting shaft 131 also descends, and the contact portions 130*a* of the movable contact 130 contact the contact portions 118*a* of the fixed contacts 111, 112 with the contact pressure of the contact spring 13.

Because of this, there exists a closed contact condition wherein the large current of the external power supply source is supplied via the fixed contact 111, movable contact 130, and fixed contact 112 to the load.

At this time, an electromagnetic repulsion force is generated between the fixed contacts 111, 112 and the movable contact 130 in a direction such as to cause the contacts of the movable contact 130 to open.

However, as the fixed contacts 111, 112 are such that the C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions.

Because of this, from the relationship between a magnetic field formed by the lower plate portions 118 of the fixed contacts 111, 112 and the current flowing through the movable contact 130, it is possible, in accordance with Fleming's left-hand rule, to generate a Lorentz force that presses the movable contact 130 against the contact portions 118*a* of the fixed contacts 111, 112.

Because of this Lorentz force, it is possible to oppose the electromagnetic repulsion force generated in the contact opening direction between the contact portions 118*a* of the fixed contacts 111, 112 and the contact portions 130*a* of the movable contact 130, and thus possible to reliably prevent the contact portions 130*a* of the movable contact 130 from opening.

Because of this, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

When interrupting the supply of current to the load in the closed contact condition of the contact mechanism 101, the exciting of the exciting coil 208 of the electromagnet unit 200 is stopped.

By so doing, the exciting force causing the movable plunger 215 to move downward in the electromagnet unit 200 decreases, because of which the movable plunger 215 is raised by the urging force of the return spring 214, and the suctioning force of the annular permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is contacting the fixed contacts 111, 112 for as long as contact pressure is applied by the contact spring 134. Subsequently, there starts an opened contact condition, wherein the movable contact 130 moves upward away from the fixed contacts 111, 112 at the point at which the contact pressure of the contact spring 134 stops.

On the opened contact condition starting, an arc is generated between the contact portions 118*a* of the fixed contacts 111, 112 and the contact portions 130*a* of the movable contact 130, and the condition in which current is conducted is continued due to the arc.

At this time, as the insulating cover 121 is mounted covering the upper plate portion 116 and intermediate plate portion 117 of the C-shaped portion 115 of the fixed contacts 111, 112, it is possible to cause the arc to be generated only between the contact portions 118*a* of the fixed contacts 111, 112 and the contact portions 130*a* of the movable contact 130. Because of this, it is possible to stabilize the arc generation condition, and thus possible to improve arc extinguishing performance.

Also, as the upper plate portion 116 and intermediate plate portion 117 of the C-shaped portion 115 are covered by the insulating cover 121, it is possible to maintain insulating distance with the insulating cover 121 between the two end portions of the movable contact 130 and the upper plate portion 116 and intermediate plate portion 117 of the C-shaped portion 115, and thus possible to reduce the height in the direction in which the movable contact 130 can move. Consequently, it is possible to reduce the size of the contact device 100.

Furthermore, as the inner surface of the intermediate plate portion 117 of the fixed contacts 111, 112 is covered by the magnetic plate 119, a magnetic field generated by current flowing through the intermediate plate portion 117 is shielded by the magnetic plate 119. Because of this, there is no interference between a magnetic field caused by the arc generated between the contact portions 118*a* of the fixed contacts 111, 112 and the contact portions 130*a* of the movable contact 130 and the magnetic field generated by the current flowing through the intermediate plate portion 117, and it is thus possible to prevent the arc from being affected by the magnetic field generated by the current flowing through the intermediate plate portion 117.

At this time, as the opposing magnetic pole faces of the arc extinguishing permanent magnets 143, 144 are N-poles, and the outer sides thereof are S-poles, magnetic flux emanating from the N-poles, seen in plan view as shown in FIG. 6(*a*), crosses an arc generation portion of a portion in which the contact portion 118*a* of the fixed contact 111 and the contact portion 130*a* of the movable contact 130 are opposed, from the inner side to the outer side in the longitudinal direction of the movable contact 130, and reaches the S-pole, whereby a magnetic field is formed.

In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing permanent magnets 143, 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 6(*b*). Because of this, in accordance with Fleming's left-hand rule, a large Lorentz force F acts toward the arc extinguishing space 145 side, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through the inside of the arc extinguishing space 145, reaching the upper surface side of the movable contact 130, and is extinguished.

Also, at the lower side and upper side of the arc extinguishing space 145, magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, the current I flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 6(*b*).

Because of this, in accordance with Fleming's left-hand rule, a large Lorentz force F acts toward the arc extinguishing space 145 side, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through the inside of the arc extinguishing space 145, reaching the side surface side of the fixed contact 112, and is extinguished.

Also, at the lower side and upper side of the arc extinguishing space 145, as heretofore described, magnetic flux inclines to the lower side and upper side with respect to the orientation of the magnetic flux between the contact portion 118*a* of the fixed contact 112 and the contact portion 130*a* of the movable contact 130.

Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, in the engaged condition of the electromagnetic contactor 10, when adopting a released condition in a condition wherein a regenerative current flows from the load side to the direct current power source side, the direction of current in FIG. 6(*b*) is reversed, meaning that the Lorentz force F acts on the arc extinguishing space 146 side, and excepting that the arc is extended to the arc extinguishing space 146 side, the same arc extinguishing function is fulfilled.

At this time, as the arc extinguishing permanent magnets 143, 144 are disposed in the magnet housing pockets 141, 142 formed in the insulating cylinder 140, the arc does not directly contact the arc extinguishing permanent magnets 143, 144. Because of this, it is possible to stably maintain the magnetic characteristics of the arc extinguishing permanent magnets 143, 144, and thus possible to stabilize interruption performance.

Also, as it is possible to cover and insulate the inner peripheral surface of the metal contact housing case 102 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143, 144, and the function of protecting the arc extinguishing permanent magnets 143, 144 from the arc with the one insulating cylinder 140, it is possible to reduce manufacturing cost.

In this way, according to the embodiment, the contact device 100 is such that the C-shaped portions 115 of the fixed contacts 111, 112 and the contact spring 134 applying the contact pressure of the movable contact 130 are disposed in parallel, because of which it is possible to reduce the height of the contact mechanism 101 compared with a case in which the fixed contacts, movable contact, and contact spring are disposed in series. Because of this, it is possible to reduce the size of the contact mechanism 100.

Also, the contact housing case 102 is formed by brazing the tubular body 104 and the plate-like fixed contact support insulating substrate 105 that closes off the upper surface of the tubular body 104 and in which the fixed contacts 111, 112 are fixed and held by brazing. Because of this, it is possible to arrange fixed contact support insulating substrates 105 in close contact vertically and horizontally on the same flat surface, possible to carry out the metalizing process on a plurality of the fixed contact support insulating substrates 105 at one time, and thus possible to improve productivity.

Also, as it is possible to braze the fixed contact support insulating substrate 105 to the tubular body 104 after the fixed contacts 111, 112 are brazed to and supported by the fixed contact support insulating substrate 105, the fixing and holding of the fixed contacts 111, 112 can be easily carried out, a simple configuration of brazing jig is sufficient, and it is thus possible to achieve a reduction in the cost of assembly jigs.

Control and management of the flatness and warpage of the fixed contact support insulating substrate 105 are also easy compared with a case in which the contact housing case 102 is formed in a tub form. Furthermore, it is possible to fabricate a large number of the contact housing case 102 at one time, and thus possible to reduce the fabricating cost.

Also, with regard to the electromagnet unit 200, the annular permanent magnet 220 magnetized in the direction in which the movable plunger 215 can move is disposed on the upper magnetic yoke 210, and the auxiliary yoke 225 is formed on the upper surface of the annular permanent magnet 220, because of which it is possible to generate suctioning force that suctions the peripheral flange portion 216 of the movable plunger 215 with the one annular permanent magnet 220.

Because of this, it is possible to carry out the fixing of the movable plunger 215 in the released condition using the magnetic force of the annular permanent magnet 220 and the urging force of the return spring 214, because of which it is possible to improve holding force with respect to malfunction shock.

Also, it is possible to reduce the urging force of the return spring 214, and thus possible to reduce the total load of the contact spring 134 and return spring 214. Consequently, it is possible to reduce the suctioning force generated in the exciting coil 208 in accordance with the amount by which the total load is reduced, and thus possible to reduce the magnetomotive force of the exciting coil 208. Because of this, it is possible to reduce the length in the axial direction of the spool 204, and thus possible to reduce the height of the electromagnet unit 200 in the direction in which the movable plunger 215 can move.

As it is possible to reduce the height in the direction in which the movable plunger 215 can move in both the contact device 100 and electromagnet unit 200 in this way, it is possible to considerably shorten the overall configuration of the electromagnetic contactor 10, and thus possible to achieve a reduction in size.

Furthermore, due to the peripheral flange portion 216 of the movable plunger 215 being disposed inside the inner peripheral surface of the annular permanent magnet 220, there is no waste in a closed circuit passing magnetic flux emitted from the annular permanent magnet 220, leakage flux decreases, and it is possible to use the magnetic force of the permanent magnet effectively.

Also, as the peripheral flange portion 216 of the movable plunger 215 is disposed between the upper magnetic yoke 210 and the auxiliary yoke 225 formed on the upper surface of the annular permanent magnet 220, it is possible to regulate the stroke of the movable plunger 215 with the thickness of the annular permanent magnet 220 and the thickness of the peripheral flange portion 216 of the movable plunger 215.

Because of this, it is possible to reduce to a minimum the cumulative number of parts and form tolerance, which affect the stroke of the movable plunger 215. Moreover, as the regulation of the stroke of the movable plunger 215 is carried out using only the thickness of the annular permanent magnet 220 and the thickness of the peripheral flange portion 216 of the movable plunger 215, it is possible to minimize variation of the stroke.

Figure 10:
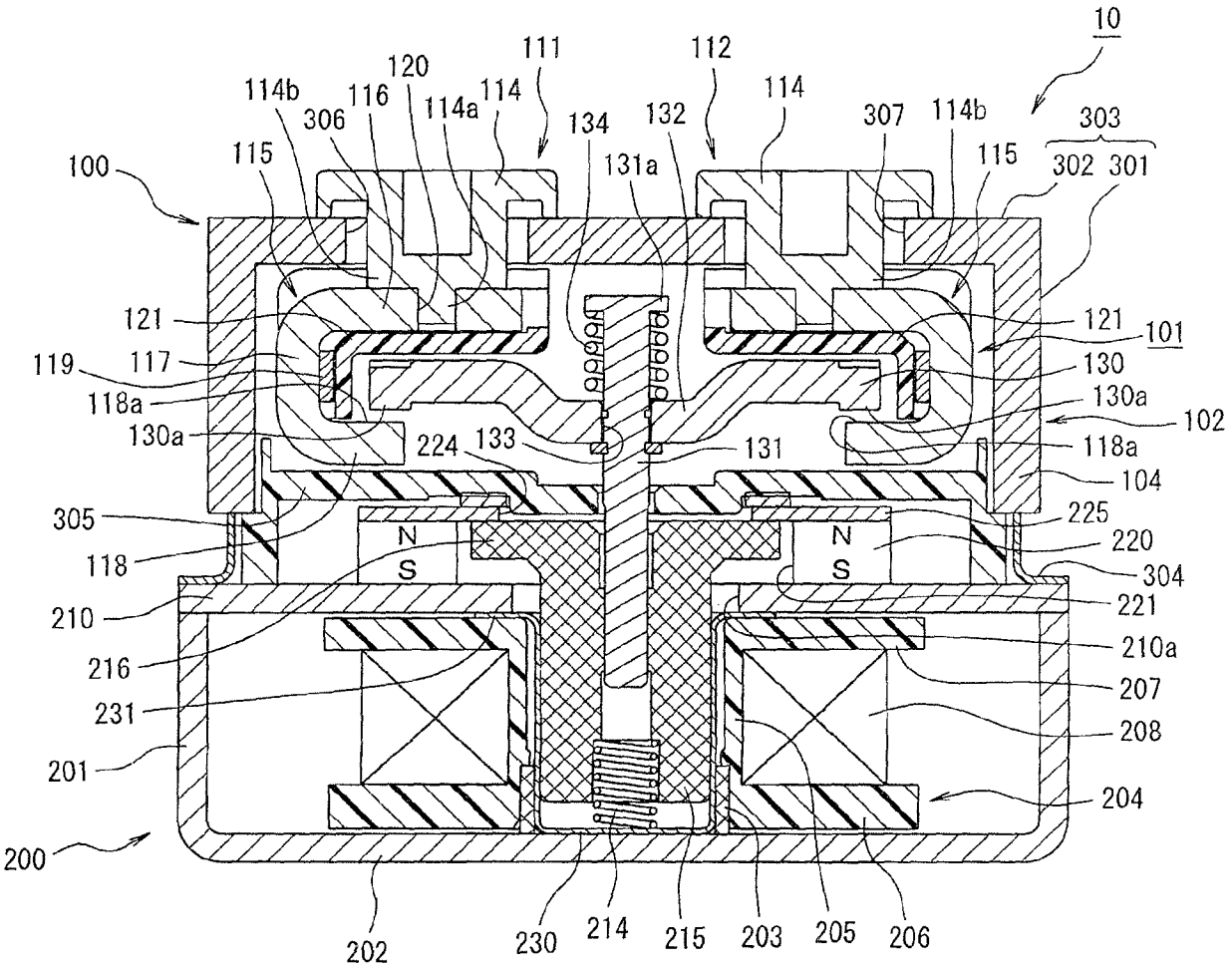
FIG. 10 is a sectional view showing another example of a contact housing case in the contact device of the invention.

In the heretofore described embodiment, a description has been given of a case wherein the contact housing case 102 of the contact device 100 is configured of the tubular body 104 and fixed contact support insulating substrate 105 but, this not being limiting, it is possible to adopt another configuration. For example, as shown in FIG. 10 and FIG. 2(*b*), the contact housing case 102 may be formed by a tubular portion 301 and an upper surface plate portion 302 closing off the upper end of the tubular portion 301 being formed integrally of a ceramic or a synthetic resin material, forming a tub-shaped body 303, a metal foil being formed on an opened end surface side of the tub-shaped body 303 by a metalizing process, and a metal connection member 304 being seal joined to the metal foil.

Also, the contact mechanism 101 not being limited to the configuration of the heretofore described embodiment either, it is possible to apply a contact mechanism of an arbitrary configuration.

Figure 11A:
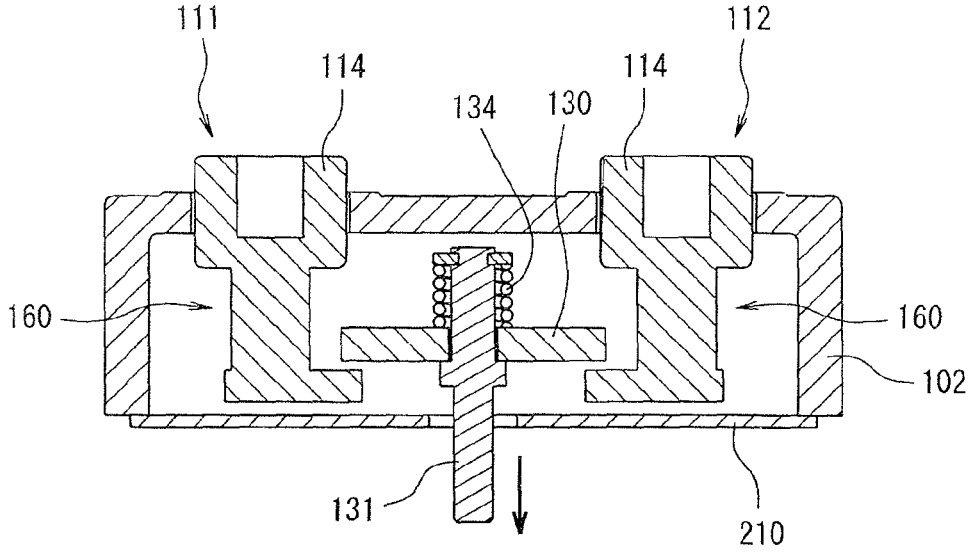
FIGS. 11(*a*), 11(*b*) are diagrams showing a modification example of a contact mechanism in the contact device of the invention, wherein FIG. 11(*a*) is a sectional view and FIG. 11(*b*) is a perspective view.
Figure 11B:
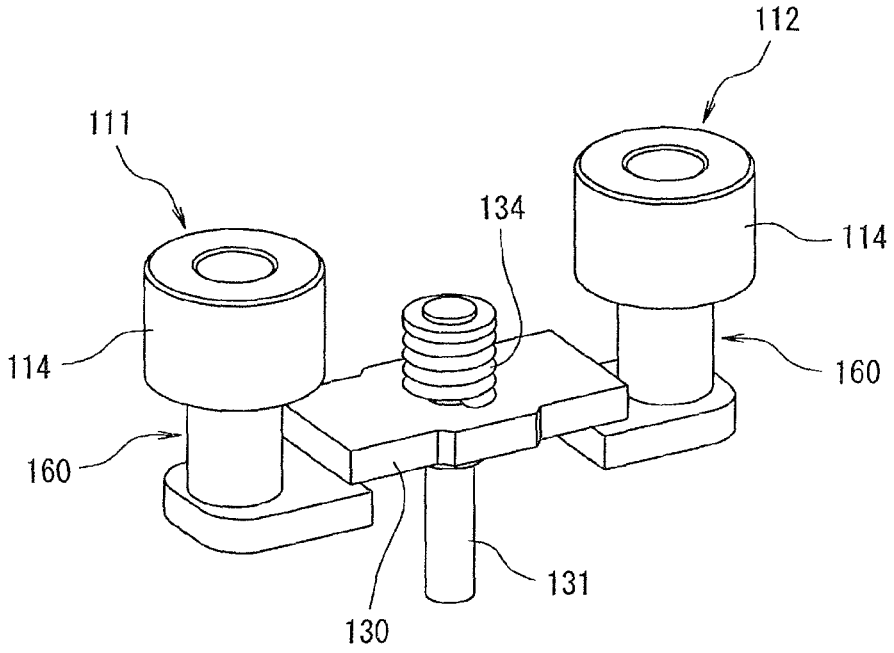

For example, an L-shaped portion 160, of a form such that the upper plate portion 116 of the C-shaped portion 115 is omitted, may be connected to the support conductor portion 114, as shown in FIGS. 11(*a*), 11(*b*). In this case too, in the closed contact condition wherein the movable contact 130 contacts the fixed contacts 111, 112, it is possible to cause magnetic flux generated by the current flowing through a vertical plate portion of the L-shaped portion 160 to act on portions in which the fixed contacts 111, 112 and the movable contact 130 are contacting. Because of this, it is possible to increase the magnetic flux density in the portions in which the fixed contacts 111, 112 and the movable contact 130 are contacting, generating a Lorentz force that opposes the electromagnetic repulsion force.

Figure 12A:
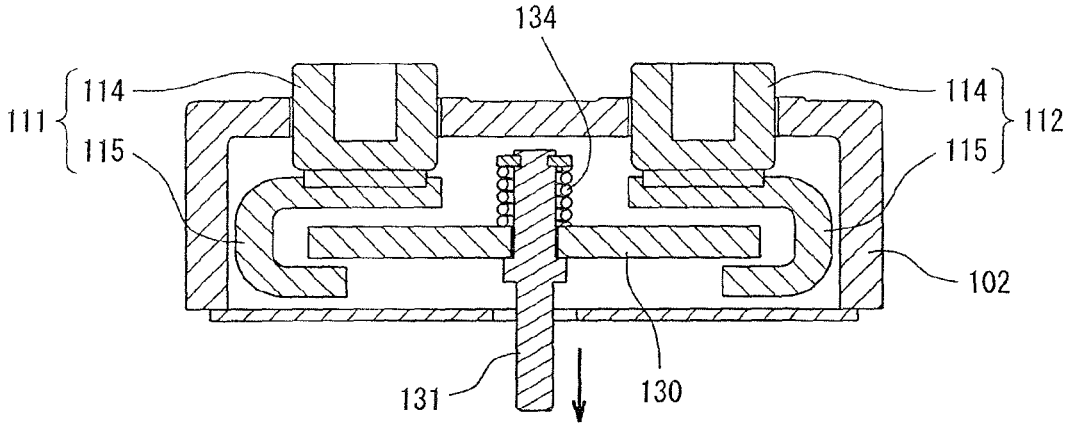
FIGS. 12(*a*), 12(*b*) are diagrams showing another modification example of a contact mechanism in the contact device of the invention, wherein FIG. 12(*a*) is a sectional view and FIG. 12(*b*) is a perspective view.
Figure 12B:
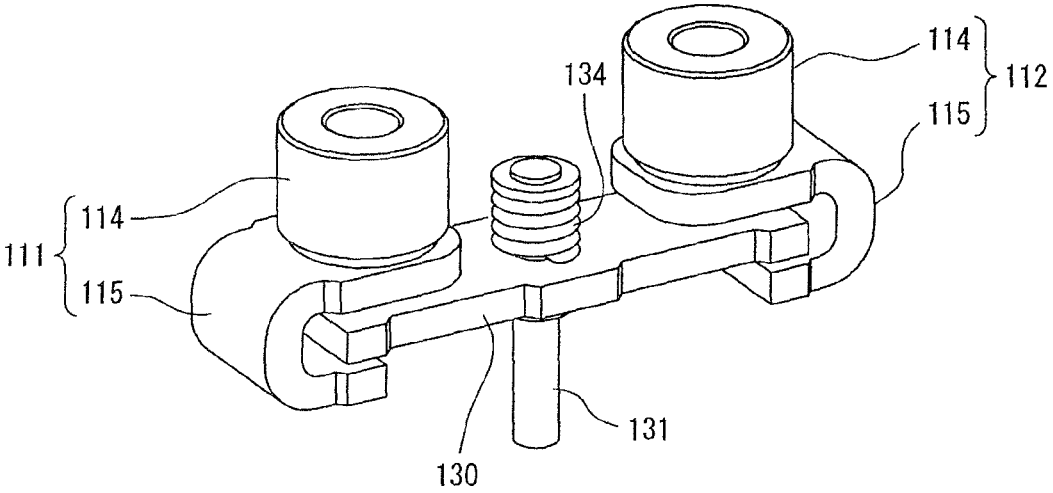

Also, the depressed portion 132 may be omitted, forming a flat plate, as shown in FIGS. 12(*a*), 12(*b*).

Also, in the heretofore described embodiment, a description has been given of a case wherein the connecting shaft 131 is screwed to the movable plunger 215 but, not being limited to screwing, it is possible to apply an arbitrary connection method, and furthermore, the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but not being limited to this. That is, a positioning large diameter portion may be formed protruding in a radial direction in the C-ring position of the connecting shaft 131, the contact spring 134 disposed after the movable contact 130 contacts the large diameter portion, and the upper end of the contact spring 134 fixed with the C-ring.

Figure 13A:
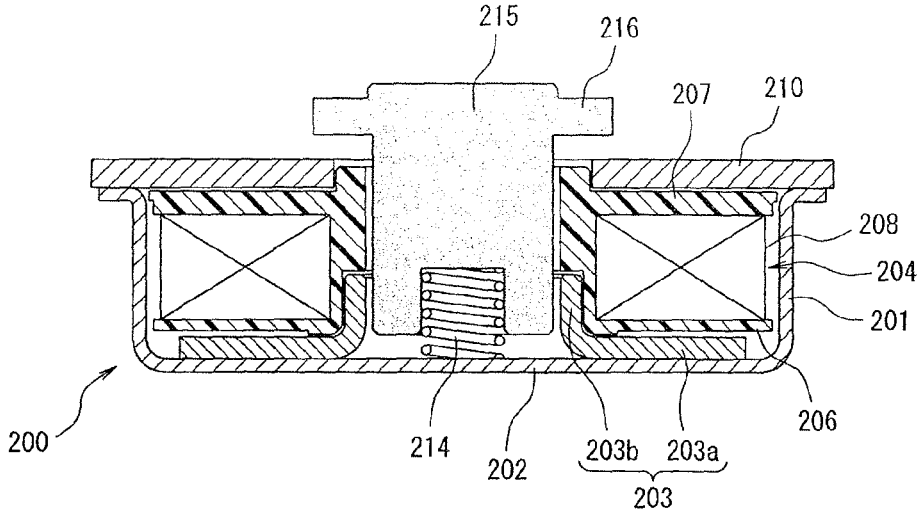
FIGS. 13(*a*), 13(*b*) are diagrams showing a modification example of a cylindrical auxiliary yoke of an electromagnet unit, wherein FIG. 13(*a*) is a sectional view and FIG. 13(*b*) is an exploded perspective view.
Figure 13B:
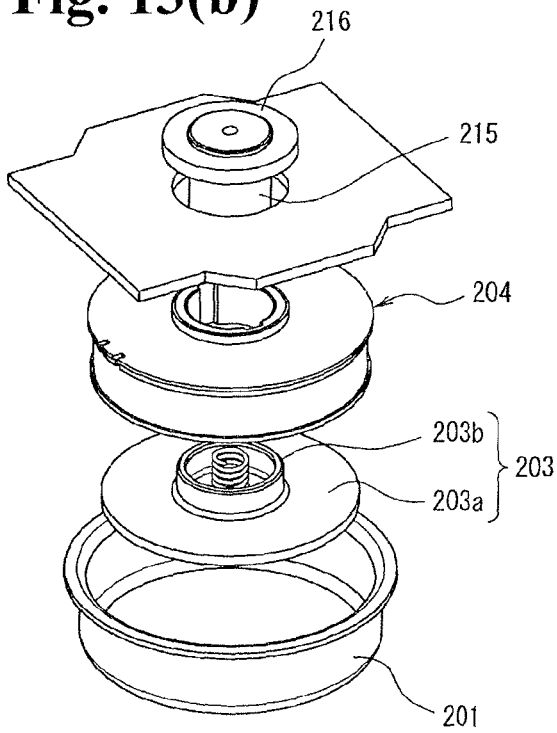

Also, in the heretofore described embodiment, a description has been given of a case wherein the cylindrical auxiliary yoke 203 is disposed in close proximity to the lower end side of the movable plunger 215, but not being limited to this. That is, the magnetic yoke 201 may be formed in a bottomed cylindrical form, as shown in FIGS. 13(*a*), 13(*b*), and the auxiliary yoke 203 configured of an annular plate portion 203*a*, coinciding with the bottom plate portion 202 of the magnetic yoke 201, and a cylinder portion 203*b* rising upward from the inner peripheral surface of the annular plate portion 203*a*.

Figure 14A:
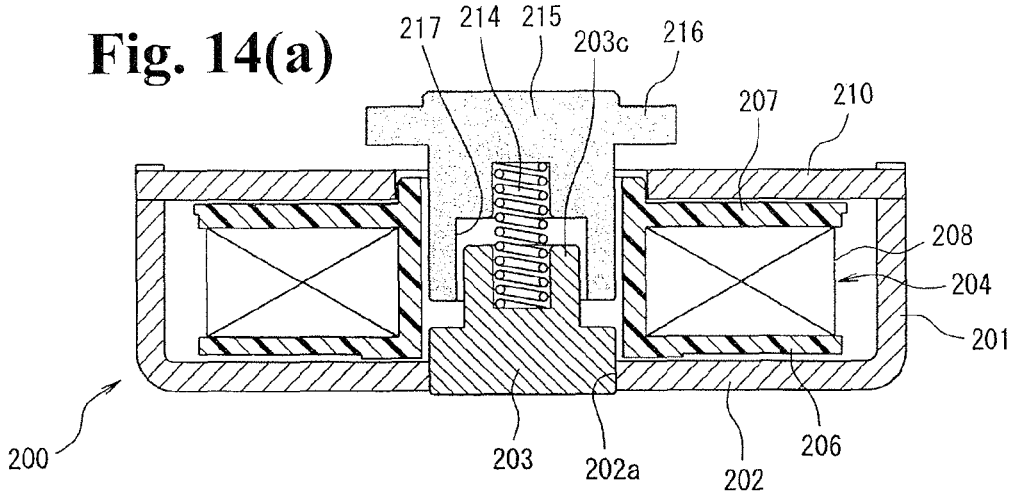
FIGS. 14(*a*), 14(*b*) are diagrams showing a modification example of a cylindrical auxiliary yoke of the electromagnet unit, wherein FIG. 14(*a*) is a sectional view and FIG. 14(*b*) is an exploded perspective view.
Figure 14B:
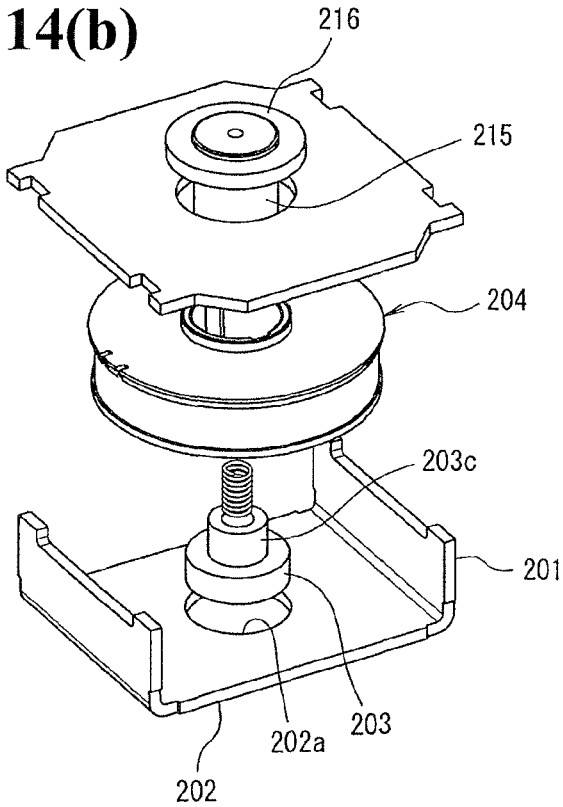

Also, as shown in FIGS. 14(*a*), 14(*b*), a through hole 202*a* may be formed in the bottom plate portion 202 of the U-shaped magnetic yoke 210, the protruding auxiliary yoke 203 fitted into the through hole 202*a*, and a small diameter portion 203*c* of the auxiliary yoke 203 inserted into an insertion hole 217 formed in the movable plunger 215.

Also, in the heretofore described embodiment, a description has been given of a case wherein a hermetic receptacle is configured of the contact housing case 102 and cap 230, and gas is encapsulated inside the hermetic receptacle but, not being limited to this, the gas encapsulation may be omitted when the interrupted current is small.

REFERENCE SIGNS LIST

10 . . . Electromagnetic contactor, 11 . . . External insulating receptacle, 100 . . . Contact device, 101 . . . Contact mechanism, 102 . . . Contact housing case, 104 . . . Tubular body, 105 . . . Fixed contact support insulating substrate, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Connecting shaft, 132 . . . Depressed portion, 134 . . . Contact spring, 140 . . . Insulating cylinder, 141, 142 . . . Magnet housing pocket, 143, 144 . . . Arc extinguishing permanent magnet, 145, 146 . . . Arc extinguishing space, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke

What is claimed is:

1. An electromagnetic contactor, comprising:

a pair of fixed contacts disposed to maintain a predetermined interval and a movable contact disposed to be capable of connecting to and separating from the pair of fixed contacts; and an electromagnet unit that drives the movable contact, including:

a plunger drive portion;

a magnetic yoke enclosing the plunger drive portion;

an upper magnetic yoke covering an upper portion of the magnetic yoke;

a movable plunger having a leading end protruding through an aperture formed in the upper magnetic yoke, a peripheral flange portion formed on a side of the protruding end, and a lower portion, the movable plunger being urged by a return spring;

an annular permanent magnet fixed onto the upper magnetic yoke to enclose the peripheral flange portion of the movable plunger, and magnetized in a moving direction of the movable plunger; and a cylindrical auxiliary yoke disposed to partly overlap the lower portion of the movable plunger so that a magnetic circuit passing through the upper magnetic yoke, magnetic yoke, auxiliary yoke and movable plunger is formed, wherein relationships among a gap g1 between a lower surface of the peripheral flange portion of the movable plunger and an upper surface of the upper magnetic yoke, a gap g2 between an outer peripheral surface of the movable plunger and the aperture of the upper magnetic yoke, a gap g3 between the outer peripheral surface of the movable plunger and the cylindrical auxiliary yoke, and a gap g4 between a lower surface of the movable plunger and an upper surface of a bottom plate portion of the magnetic yoke are set as $g1<g2$ and $g3<g4$ when the plunger drive portion is not energized.

2. The electromagnetic contactor according to claim 1, wherein the magnetic yoke comprises:

a U-shaped cross-sectional magnetic yoke having the upper portion opened, and supporting a spool wound with an exciting coil, and having the movable plunger movably disposed in a central portion of the spool.

3. The electromagnetic contactor according to claim 2, wherein the annular permanent magnet is disposed on a periphery of the aperture on an outer surface of the upper magnetic yoke, and includes another auxiliary yoke on a side opposite to the upper magnetic yoke and facing a side opposite of the upper magnetic yoke of the peripheral flange portion of the movable plunger.

4. The electromagnetic contactor according to claim 1, wherein a thickness of the permanent magnet is set to a sum of a thickness of the peripheral flange portion of the movable plunger and a stroke of the movable plunger.

5. The electromagnetic contactor according to claim 1, wherein at least the fixed contacts and movable contact, and the movable plunger, are disposed in a receptacle encapsulating a gas.

6. The electromagnetic contactor according to claim 1, further comprising:

an arc extinguishing chamber housing a contact mechanism having the pair of fixed contacts and the movable contact, wherein the arc extinguishing chamber is formed as a tub-shaped body formed integrally from a tubular portion and an upper surface plate portion closing off an upper end of the tubular portion, and a metal foil is formed on an opened end surface side of the tub-shaped body by a metalizing process, and the metal foil is seal joined with a metal connection member.

7. The electromagnetic contactor according to claim 1, wherein the pair of fixed contacts includes:

support conductor portions maintaining a predetermined interval and supported at an upper plate of an arc extinguishing chamber housing a contact mechanism having the pair of fixed contacts and the movable contact, and C-shaped portions linked to end portions of the support conductor portions inside the arc extinguishing chamber, wherein each C-shaped portion has at least a contact portion formed on an upper plate side, a lower plate portion parallel with the upper plate, and an intermediate plate portion formed, on an outer end portion of the lower plate portion, in close proximity to the contact portion and extending to the upper plate side, and the movable contact is mounted through a contact spring to an end portion on the upper plate side on a connecting shaft connected to the drive portion, and is disposed to face contact portions of the pair of fixed contacts from the upper plate side.

8. The electromagnetic contactor according to claim 7, wherein the C-shaped portion is formed in an L-shape formed from the lower plate portion and intermediate plate portion.

9. The electromagnetic contactor according to claim 7, wherein the movable contact is formed in a flat plate shape parallel to the upper plate.

10. The electromagnetic contactor according to claim 7, wherein the movable plunger and connecting shaft are formed integrally.

11. The electromagnetic contactor according to claim 7, wherein the connecting shaft is formed with a positioning large diameter portion protruding in a radial direction, and after the movable contact is inserted from an upper end of the connecting shaft and the movable contact abuts against the positioning large diameter portion, the contact spring is inserted from the upper end of the connecting shaft to dispose, and the upper end of the connecting shaft is fixed with a C-ring.

12. The electromagnetic contactor according to claim 1, wherein the magnetic yoke is formed in a bottomed cylindrical shape, and the auxiliary yoke includes an annular plate portion formed along the bottom plate portion of the magnetic yoke, and a cylinder portion rising upward from an inner peripheral surface of the annular plate portion.

13. The electromagnetic contactor according to claim 2, wherein a through hole is formed in the bottom plate portion of the U-shaped cross-sectional magnetic yoke, the auxiliary yoke is fitted into the through hole, and a small diameter portion of the auxiliary yoke is inserted into an insertion hole formed in the movable plunger.

14. The electromagnetic contactor according to claim 1, wherein the relationships among g1, g2, g3, g4 are set as $g1<g2$ and $g3>g4$ when the plunger drive portions is energized.

* * * * *

UNITED STATES PATENT AND TRADEMARK OFFICE

CERTIFICATE OF CORRECTION

PATENT NO. : 9,202,652 B2
APPLICATION NO. : 14/115263
DATED : December 1, 2015
INVENTOR(S) : Yasuhiro Naka et al.

It is certified that error appears in the above-identified patent and that said Letters Patent is hereby corrected as shown below:

IN THE SPECIFICATION

Please change column 3, line 32, from "Lime, the movable …" to --time, the movable …--.

Signed and Sealed this
Ninth Day of February, 2016

Michelle K. Lee

Michelle K. Lee
*Director of the United States Patent and Trademark Office*